US005752421A

United States Patent [19]

Chang

[11] Patent Number: 5,752,421

[45] Date of Patent: May 19, 1998

[54] CUTTING DEVICE WITH A PIVOTABLE COVER MEMBER FOR COVERING AND UNCOVERING A CUTTING PORTION OF A CUTTING TOOL

[75] Inventor: Chiu-Tsun Chang, Taichung, Taiwan

[73] Assignee: P & F Industrial Corporation, Taichung, Taiwan

[21] Appl. No.: 871,639

[22] Filed: Jun. 9, 1997

[51] Int. Cl.[6] ..... B27B 5/18

[52] U.S. Cl. ..... 83/397; 83/478; 83/490

[58] Field of Search ..... 83/397, 471.3, 83/478, 490, 581, DIG. 1

[56] References Cited

U.S. PATENT DOCUMENTS

| | | | |
|---|---|---|---|
| 4,028,975 | 6/1977 | Bennett | 83/397 |
| 4,581,966 | 4/1986 | Kaiser et al. | 83/397 |
| 4,799,416 | 1/1989 | Kumasaka et al. | 83/397 |
| 4,805,504 | 2/1989 | Fushiya et al. | 83/397 |
| 5,203,245 | 4/1993 | Terpstra | 83/397 |
| 5,370,025 | 12/1994 | Itzov | 83/478 |
| 5,513,548 | 5/1996 | Garuglieri | 83/397 |
| 5,609,085 | 3/1997 | Chang | 83/397 |
| 5,638,731 | 6/1997 | Garuglieri | 83/397 |

*Primary Examiner*—Maurina T. Rachuba
*Attorney, Agent, or Firm*—Cushman Darby & Cushman IP Group of Pillsbury Madison & Sutro LLP

[57] ABSTRACT

A cutting device includes an upright post, a hollow tool carrier mounted swingably on the post, a cutting tool mounted rotatably on the tool carrier, and a cover member mounted pivotally to the tool carrier so as to cover a portion of the cutting tool. A moving device is employed for moving the cover member, and includes a stationary base which extends into the tool carrier and which is formed with an elongated guide slot, and an L-shaped lever which is disposed in the tool carrier and which has an upper portion, a lower portion that engages slidably the guide slot, and an angled intermediate portion that is disposed between the upper and lower portions and that is mounted pivotally to the tool carrier. A curved link is disposed in the tool carrier and has two opposite ends pivoted respectively to the cover member and the upper portion of the L-shaped lever. Downward swinging movement of the tool carrier on the post results in corresponding movement of the lower portion of the L-shaped lever along the guide slot to cause the L-shaped lever to pivot inside the tool carrier and pull the curved link. The cover member is moved swiftly from a covering position to an uncovering position, wherein the portion of the cutting tool is exposed from the tool carrier.

9 Claims, 6 Drawing Sheets

CUTTING DEVICE WITH A PIVOTABLE COVER MEMBER FOR COVERING AND UNCOVERING A CUTTING PORTION OF A CUTTING TOOL

BACKGROUND OF THE INVENTION

1. Field of the Invention

The invention relates to a cutting device, more particularly to a cutting device with a cover member that exposes a cutting portion of a cutting tool only when the cutting device is in use and that covers the cutting portion when the cutting device is not in use.

2. Description of the Related Art

Referring to FIGS. 1 and 2, a conventional cutting device is shown to comprise a bench 10 with an upright post 11, a tool carrier 12 shaped as a hollow rectangular casing, a circular cutting tool 13, a cover member 14, means for moving the cover member 14 relative to the tool carrier 12, and safety lock means for preventing untimely movement of the cover member 14 relative to the tool carrier 12.

As illustrated, the tool carrier 12 is mounted swingably on the upright post 11 such that the tool carrier 12 is disposed normally at an inclined position above the bench 10. The tool carrier 12 has a bottom portion formed with a tool opening 121. The cutting tool 13 is mounted rotatably on the tool carrier 12 and has a cutting portion that extends out of the tool opening 121 of the tool carrier 12. The cover member 14 is mounted pivotally on the tool carrier 12 at the pivot axis of the cutting tool 13, and is movable between a covering position, wherein the cover member 14 covers the cutting portion of the cutting tool 13, and an uncovering position, wherein the cover member 14 exposes the cutting portion of the cutting tool 13. The moving means includes a swing rod 15 which is disposed in the tool carrier 12 and which has a lower portion pivoted to the post 11, and an L-shaped connector 16 which is similarly disposed in the tool carrier 12 and which has a first end connected pivotally to an upper portion of the swing rod 15, and a second end connected to the cover member 14 offset from the pivot axis of the latter. The safety lock means includes a stop plate 17, a swing lever 18 and a push button 19. The stop plate 17 has an intermediate portion pivoted to an inner surface of the tool carrier 12. The swing lever 18 is disposed above the stop plate 17 and has a middle section mounted pivotally to the tool carrier 12, a lower section movably retained in a curved guide slot 172 formed in the stop plate 17 in such a manner that a front end face 171 of the stop plate 17 abuts against an abutment portion 161 on the connector 16, and an upper section connected operably to the push button 19. The safety lock means prevents movement of the L-shaped connector 16 in the tool carrier 12 in order to prevent downward swinging movement of the tool carrier 12 in a locking position, and permits movement of the L-shaped connector 16 in the tool carrier 12 in order to permit downward swinging movement of the tool carrier 12 upon operation of the push button 19 to result in corresponding movement of the swing lever 18 and disengagement of the stop plate 17 from the connector 16 and permit pivotal movement of the connector 16 in the tool carrier 12.

It is noted that the opening movement of the cover member 14 is relatively slow due to the particular connection among the swing rod 15, the connector 16 and the cover member 14. Thus, the slow movement of the cover member 14 may result in collision with a workpiece 100 on the bench 10 during cutting.

U.S. Pat. No. 5,609,085 discloses a cutting device with a cover member that can swiftly uncover a cutting portion of a cutting tool upon downward swinging movement of a tool carrier thereof. The cutting device comprises a bench with an upright post, a tool carrier mounted swingably on the upright post and disposed normally at an inclined position with respect to the bench, a cutting tool, a motor for driving the cutting tool, a semi-circular cover member, and means for moving the cover member between two positions. The tool carrier has the cutting tool mounted rotatably therein, and a bottom portion formed with a tool opening for exposing a portion of the cutting tool. The moving means includes a guide flange formed integrally on an inner surface of the cover member, an elongated rod provided within the tool carrier and connected pivotally to the upright post, and a generally C-shaped crank. The crank has a first end mounted pivotally to the tool carrier, a second end engaging slidably the guiding flange of the cover member, and an angular portion that is formed between the first and second ends and that is connected pivotally to the elongated rod. The tool carrier further has a press roller mounted rotatably therein for pressing the elongated rod when the tool carrier is pivoted relative to the bench. Pivoting action of the tool carrier toward the bench enables the press roller to depress the elongated rod, thereby urging the angular portion of the crank to pivot and move the cover member to an uncovering position, wherein the cover member exposes the cutting portion of the cutting tool. The angular portion of the crank has a roller mounted thereon. The elongated rod has an elongated guide slot formed therein to receive the roller such that the roller can rotate in the guide slot. No safety lock is installed to prevent downward swinging movement of the tool carrier when the cutting device is not in use.

SUMMARY OF THE INVENTION

The main object of this invention is to provide a cutting device which has a cover member that can swiftly uncover the cutting portion of a cutting tool so as to avoid collision of the cover member with a workpiece to be cut.

Another object of this invention is to provide a cutting device which has a safety lock that can prevent downward movement of the tool carrier when the cutting device is not in use.

A cutting device according to this invention comprises a bench with an upright post, a hollow tool carrier, a circular cutting tool, a cover member, and moving means for moving the cover member between a covering position and an uncovering position. The tool carrier is mounted swingably on the upright post such that the tool carrier is disposed normally at an inclined position above the bench. The tool carrier has a bottom portion formed with a tool opening. The cutting tool is mounted rotatably on the tool carrier, and has a portion exposed via the tool opening of the tool carrier. The cover member is mounted pivotally to the tool carrier and is movable between a covering position, wherein the cover member covers the portion of the cutting tool, and an uncovering position, wherein the cover member exposes the portion of the cutting tool. The moving means includes a stationary base which extends into the tool carrier and which is formed with an elongated guide slot, an L-shaped lever which is disposed in the tool carrier and which has an upper portion, a lower portion that engages slidably the guide slot, and an angled intermediate portion that is disposed between the upper and lower portions and that is mounted pivotally to the tool carrier. A curved link is disposed in the tool carrier and has two opposite ends pivoted respectively to the cover member and the upper portion of the L-shaped lever. Downward swinging movement of the tool carrier on the upright post results in corresponding movement of the lower portion of the L-shaped lever along the guide slot to cause the L-shaped lever to pivot inside the tool carrier and pull the curved link. Thus, the cover member can be moved swiftly from the covering position to the uncovering position to avoid collision of the cover member with a workpiece to be cut.

Preferably, a releasable safety lock is mounted on the tool carrier and is associated operably with the curved link in order to prevent movement of the curved link in the tool carrier so as to prevent downward swinging movement of the tool carrier in a locking position, and in order to permit movement of the curved link in the tool carrier so as to permit downward swinging movement of the tool carrier in an unlocking position.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
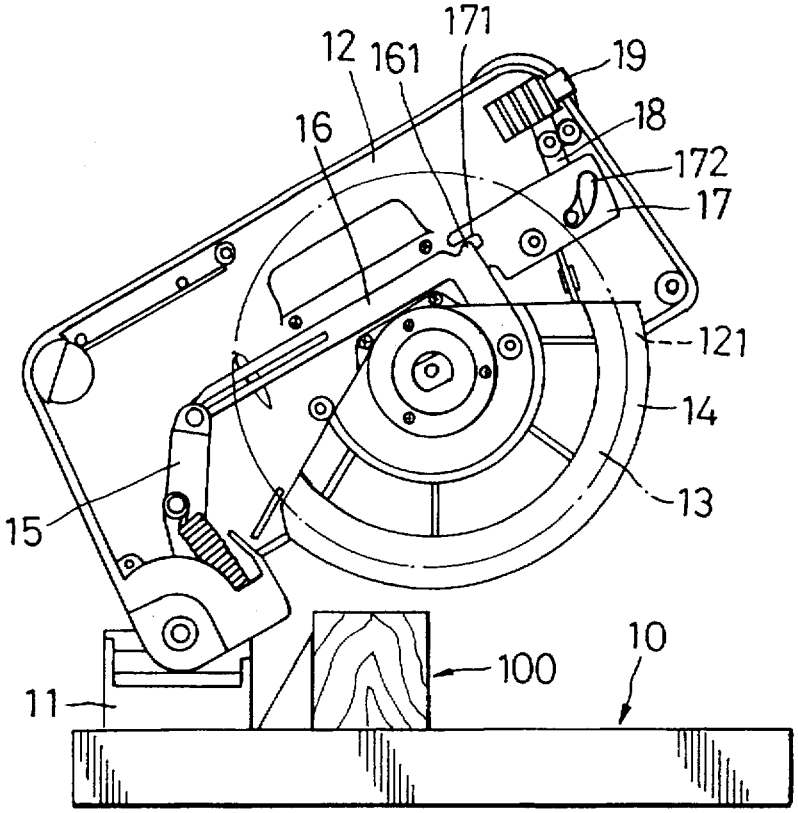
FIG.1 PRIOR ART
FIG. 1 is a side view of a conventional cutting device, wherein a tool carrier of the same is disposed at a non-operative position.
Figure 2:
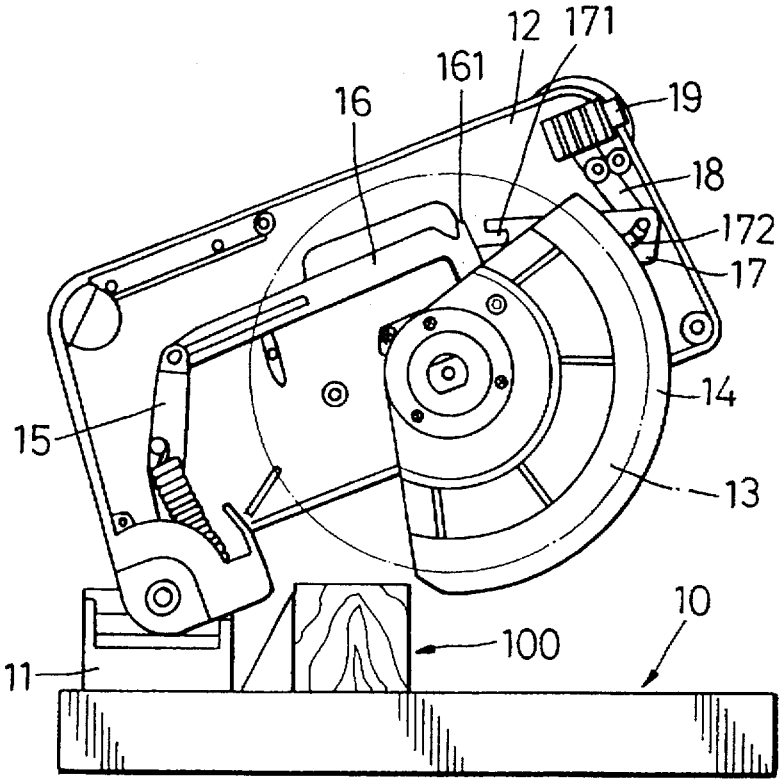
FIG.2 PRIOR ART
FIG. 2 is a side view of the conventional cutting device, illustrating how a cover member exposes the cutting portion of a cutting tool during downward swinging movement of a tool carrier.
Figure 3:
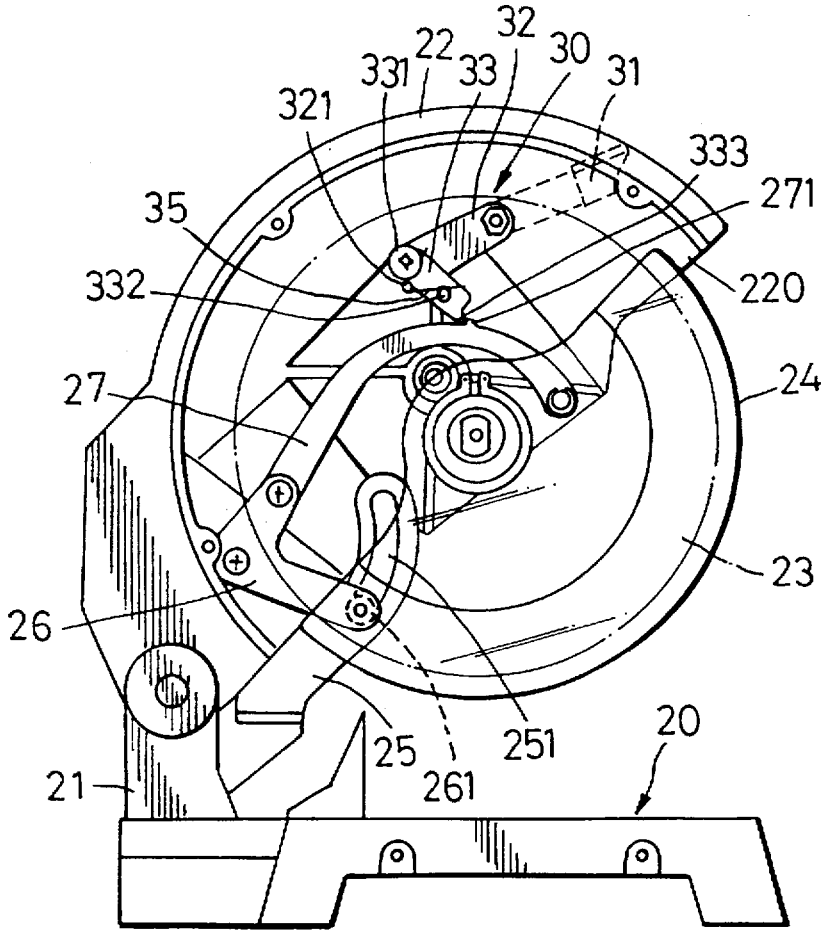
FIG. 3 is a side view of the preferred embodiment of a cutting device of this invention in a non-operative position.
Figure 4:
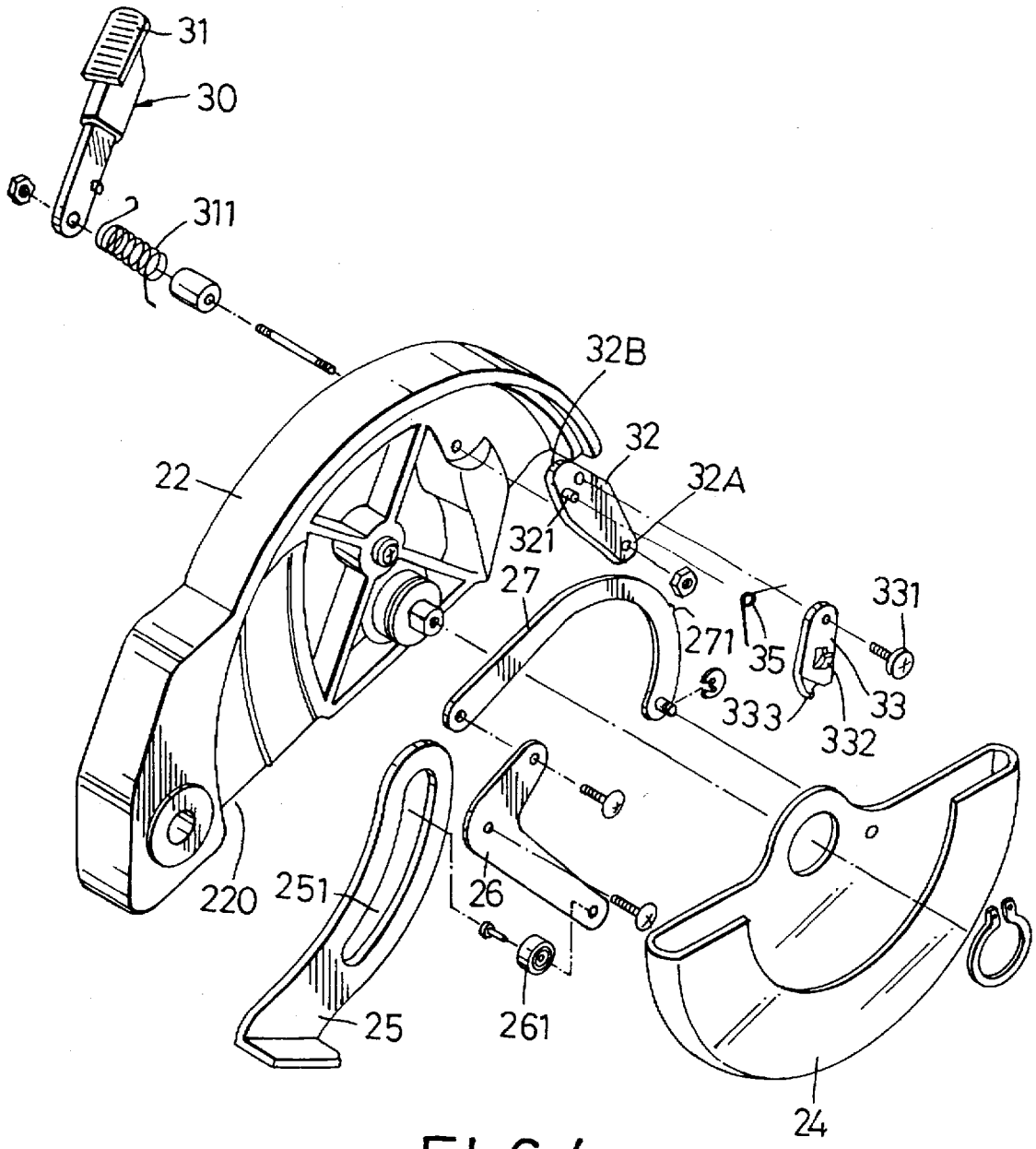
FIG. 4 is an exploded view of a portion of the preferred embodiment of this invention.

Referring to FIGS. 3 and 4, the preferred embodiment of a cutting device according to this invention is shown to comprise a horizontal bench 20 with an upright post 21, a hollow tool carrier 22, a circular cutting tool 23, a curved cover member 24, moving means for moving the cover member 24 between covering and uncovering positions with respect to the cutting tool 22, and a releasable safety lock 30.

As illustrated, the tool carrier 22 is mounted swingably on the upright post 21 such that the tool carrier 22 is disposed normally at an inclined position above the bench 20. The tool carrier 22 is formed as a hollow casing with a semi-circular shape, and has a bottom portion formed with a tool opening 220. The cutting tool 23 is mounted rotatably on the tool carrier 22 and is connected to the axle of a driving motor (not shown) for co-rotation therewith. A cutting portion of the cutting tool 23 is exposed via the opening 220 of the tool carrier 22. The cover member 24 is mounted rotatably on the tool carrier 22 at the axis of rotation of the cutting tool 23. The cover member 24 is movable between a covering position, wherein the cover member 24 covers the cutting portion of the cutting tool 23, and an uncovering position, wherein the cover member 24 exposes the cutting portion of the cutting tool 23 from the opening 220 of the tool carrier 22. The moving means includes a stationary base 25, an L-shaped lever 26, and a generally C-shaped curved link 27. The stationary base 25 has a lower portion fixed to the upright post 21, and an upper portion which extends upwardly into the tool carrier 22 and which is formed with an elongated guide slot 251. The L-shaped lever 26 is disposed in the tool carrier 22 and has an upper portion, a lower portion that engages slidably the guide slot 251, and an angled intermediate portion that interconnects the upper and lower portions and that is mounted pivotally to the tool carrier 22. The curved link 27 is disposed in the tool carrier 22 and has two opposite ends pivoted respectively to the cover member 24 and the upper portion of the L-shaped lever 26. In the embodiment, the lower portion of the L-shaped lever 26 is provided with a roller 261 which is movably retained in the guide slot 261 of the base 25.

The preferred embodiment further includes a releasable safety lock 30 which is mounted on the tool carrier 22 and which is operably associated with the curved link 27. The safety lock 30 prevents movement of the curved link 27 in the tool carrier 22 in order to prevent downward swinging movement of the tool carrier 22 in a locking position, and permits movement of the curved link 27 in the tool carrier 22 in order to permit downward swinging movement of the tool carrier 22 in an unlocking position. The safety lock 30 includes an operating lever 31, a connector 32, and a latch member 33. The operating lever 31 is mounted pivotally on an outer side of the tool carrier 22. The connector 32 is disposed inside the tool carrier 22 and has one end 32A connected to the operating lever 31 such that pivoting movement of the operating lever 31 results in corresponding pivoting movement of the connector 32. The latch member 33 is mounted pivotally on the other end 32B of the connector 32 by the use of a screw 331, and engages releasably the curved link 27. The operating lever 31 is operable so as to result in corresponding movement of the connector 32 and the latch member 33 in order to disengage the latch member 33 from the curved link 27.

In the preferred embodiment, the curved link 27 is formed with a locking protrusion 271. The latch member 33 is formed with a hook unit 333. A first biasing member 35, such as a torsion spring, is sleeved on a pin 321 on the connector 33, and has a first end that abuts against the screw 331, and a second end that abuts against a projection 332 on the latch member 33 such that the hook unit 333 engages releasably the locking protrusion 271 of the curved link 27. A second biasing member 311 is interposed between the connector 32 and the operating lever 31 in such a manner that, at the normal position, the operating lever 31 is disposed in a non-operative condition, as best illustrated in FIG. 3.

Figure 5:
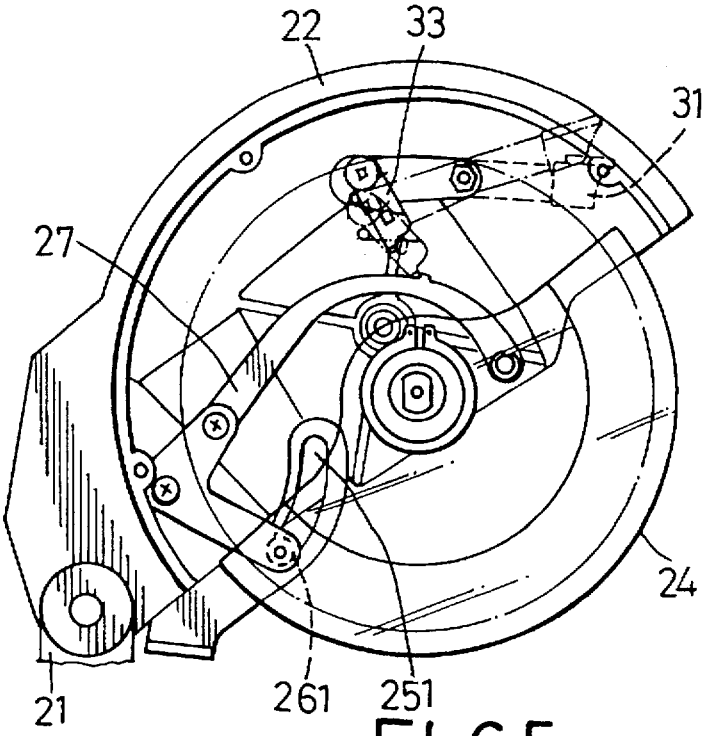
FIG. 5 illustrates how a safety lock employed in the preferred embodiment is actuated prior to downward swinging movement of a tool carrier of the preferred embodiment.
Figure 6:
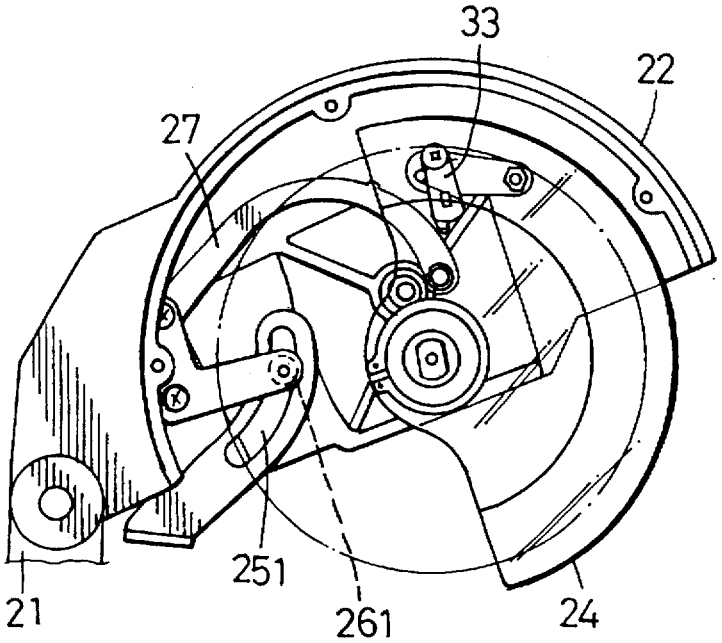
FIGS. 6 and 7 are sectional views of the preferred embodiment, illustrating movement of a cover member relative to a cutting tool during downward swinging of the tool carrier.

Referring to FIGS. 5 and 6, prior to operating the preferred embodiment, the operating lever 31 can be activated so as to release the latch member 33 from the curved link 27, thereby permitting downward swinging movement of the tool carrier 22 on the upright post 21. Note that a slight movement of the roller 261 in the guide slot 251 results in a swift pulling action on the curved link 27, thereby moving the cover member 24 from the covering position of FIG. 5 to the uncovering position of FIG. 6.

Figure 7:
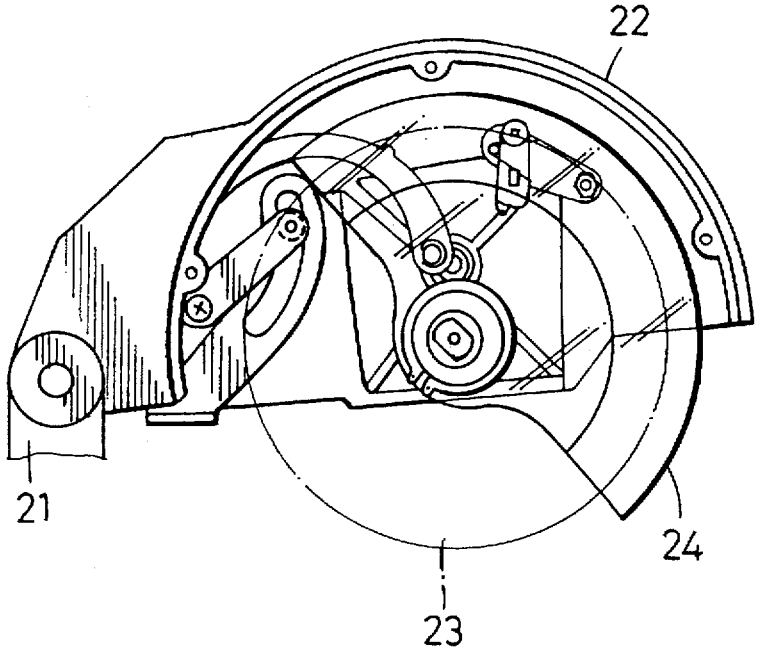

As illustrated in FIG. 7, when desired, the tool carrier 22 can be further swung downward relative to the upright post 21 in order to pivot the cover member 24 swiftly with respect to the tool carrier 22 and expose a larger cutting portion of the cutting tool 23 such that collision of the cover member 24 with a workpiece (not shown) to be cut can be obviated.

With this invention thus explained, it is apparent that numerous modifications and variations can be made without departing from the scope and spirit of this invention. It is therefore intended that this invention be limited only as indicated in the appended claims.

I claim:

1. A cutting device comprising:

a bench with an upright post;

a hollow tool carrier mounted swingably on said upright post and disposed normally at an inclined position above said bench, said tool carrier having a bottom portion formed with a tool opening;

a circular cutting tool mounted rotatably on said tool carrier and having a portion extending out of said tool opening of said tool carrier;

a curved cover member mounted pivotally to said tool carrier and movable between a covering position, wherein said cover member covers said portion of said cutting tool, and an uncovering position, wherein said cover member exposes said portion of said cutting tool; and moving means for moving said cover member between said covering and uncovering positions, said moving means including:

a stationary base which extends into said tool carrier and which is formed with an elongated guide slot, an L-shaped lever which is disposed in said tool carrier and which has an upper portion, a lower portion that engages slidably said guide slot, and an angled intermediate portion that interconnects said upper and lower portions and that is mounted pivotally to said tool carrier, and a curved link which is disposed in said tool carrier and which has two opposite ends pivoted respectively to said cover member and said upper portion of said L-shaped lever, downward swinging movement of said tool carrier on said upright post resulting in corresponding movement of said lower portion of said L-shaped lever along said guide slot to cause said L-shaped lever to pivot inside said tool carrier and pull said curved link, thereby moving said cover member from said covering position to said uncovering position.

2. The cutting device as defined in claim 1, wherein said stationary base extends upwardly from said upright post.

3. The cutting device as defined in claim 1, wherein said lower portion of said L-shaped lever is provided with a roller which is movably retained in said guide slot.

4. The cutting device as defined in claim 1, wherein said curved link is generally C-shaped and is pivoted to one end of said cover member.

5. The cutting device as defined in claim 1, further comprising a releasable safety lock which is mounted on said tool carrier and which is associated operably with said curved link, said safety lock preventing movement of said curved link in said tool carrier in order to prevent downward swinging movement of said tool carrier in a locking position, and permitting movement of said curved link in said tool carrier in order to permit downward swinging movement of said tool carrier in an unlocking position.

6. The cutting device as defined in claim 5, wherein said safety lock comprises:

an operating lever which is mounted pivotally on an outer side of said tool carrier, a connector which is disposed inside said tool carrier and which has one end connected to said operating lever such that pivoting movement of said operating lever results in corresponding pivoting movement of said connector, and an opposite end, and a latch member which is mounted pivotally on said opposite end of said connector and which engages releasably said curved link, said operating lever being operable so as to result in corresponding movement of said connector and said latch member in order to disengage said latch member from said curved link.

7. The cutting device as defined in claim 6, wherein said curved link is formed with a locking protrusion, and said latch member is formed with a hook unit for engaging releasably said locking protrusion.

8. The cutting device as defined in claim 7, wherein said safety lock further comprises a biasing member for biasing said latch member to engage releasably said locking protrusion.

9. The cutting device as defined in claim 6, wherein said safety lock further comprises a biasing member for biasing said operating lever in a normal non-operative position.

* * * * *